US008747119B2

(12) United States Patent
Hsu

(10) Patent No.: US 8,747,119 B2
(45) Date of Patent: Jun. 10, 2014

(54) ROTATABLE ELECTRICAL PLUG

(75) Inventor: Jung-Hui Hsu, New Taipei (TW)

(73) Assignee: Powertech Industrial Co., Ltd., New Taipei (TW)

( * ) Notice: Subject to any disclaimer, the term of this patent is extended or adjusted under 35 U.S.C. 154(b) by 65 days.

(21) Appl. No.: 13/491,354

(22) Filed: Jun. 7, 2012

(65) Prior Publication Data

US 2013/0288490 A1 Oct. 31, 2013

(30) Foreign Application Priority Data

Apr. 26, 2012 (TW) ..... 101114995 A

(51) Int. Cl.
*H01R 39/00* (2006.01)

(52) U.S. Cl.
USPC ..... 439/13

(58) Field of Classification Search
USPC ..... 439/13, 18, 21
See application file for complete search history.

(56) References Cited

U.S. PATENT DOCUMENTS

| | | | | |
|---|---|---|---|---|
| 5,399,093 | A | 3/1995 | Schneider et al. | |
| 5,775,921 | A * | 7/1998 | Chou | 439/21 |
| 6,793,499 | B1 * | 9/2004 | Chen | 439/13 |
| 7,566,223 | B2 | 7/2009 | Wadsworth | |
| 7,819,665 | B1 * | 10/2010 | Nishizawa | 439/13 |
| 7,850,458 | B2 * | 12/2010 | Wadsworth | 439/21 |
| 7,914,292 | B2 * | 3/2011 | Honda | 439/21 |
| 7,946,852 | B2 * | 5/2011 | John | 439/21 |
| 8,002,554 | B2 * | 8/2011 | Wadsworth | 439/18 |
| 8,123,528 | B2 * | 2/2012 | Devlin et al. | 439/21 |

FOREIGN PATENT DOCUMENTS

| | | |
|---|---|---|
| CN | 2253877 | 5/1997 |

* cited by examiner

*Primary Examiner* — Amy Cohen Johnson
*Assistant Examiner* — Vladimir Imas
(74) *Attorney, Agent, or Firm* — Li & Cai Intellectual Property (USA) Office

(57) ABSTRACT

The present invention discloses a rotatable electrical plug. The rotatable electrical plug includes a housing, a first conductor, a second conductor, a third conductor, and a rotator. The first conductor, the second conductor, and the third conductor are provided in a first conductive region, a second conductive region, and a third conductive region in the housing respectively, wherein the projection regions of the first conductive region and the second conductive region in the normal direction of the housing are overlapped. Both of the first conductor and the second conductor are of a tubular form formed by a single metal sheet, and the first conductor, the second conductor, and the third conductor are electrically contacted to a first contactor, a second contactor, and a third conductor in the inner side of the rotator respectively. The volume of the rotatable electrical plug is greatly reduced so as to enhance the convenience.

15 Claims, 10 Drawing Sheets

ROTATABLE ELECTRICAL PLUG

BACKGROUND OF THE INVENTION

1. Technical Field

The present invention relates to a rotatable electrical plug, and more particularly, to a rotatable electrical plug having an effectively reduced size.

2. Description of Related Art

With development of the science and technologies, various domestic appliance products have become indispensable to the life, what accompanies this is massive demands for electric power. In order to supply electric power for these domestic appliance products, an electrical plug must be used to connect a receptacle to receive the power. Sometimes, the electrical plug must be inserted in different directions in order to adapt to the position of the receptacle, and this is likely to cause excessive rotation or bending of electrical wires and thus increases the probability of damaging the electrical wires.

U.S. Pat. No. 5,399,093 discloses a rotatable electrical plug, which has a rotary electrical connection device comprising a first set of conductors and a second set of conductors. The first set of conductors is contacted and connected with conductors of corresponding electrical wires, and the second set of conductors is contacted and connected with conductors of corresponding plug pins. Therefore, after the first set of conductors and the second set of conductors are electrically connected, the electrical wires and the plug pins can be electrically connected. Furthermore, when the electrical plug has two plug pins, the first set of conductors has two conductive pieces, and the two conductive pieces are both an annular metal sheet and must both surround a center of a housing of the electrical plug while being electrically isolated from each other. One of the conductive pieces is disposed as an inner ring, and the other of the conductive pieces is disposed as an outer ring.

If such a design is applied to an electrical plug having three plug pins, then the first set of conductors has three conductive pieces, with one of the conductive pieces being disposed as an innermost ring and the other two of the conductive pieces being disposed as a middle ring and an outermost ring. Because the number of the conductive pieces varies with the number of the plug pins and the conductive pieces are transversely arranged in the housing of the electrical plug in sequence, a too large transverse dimension of the electrical plug will be caused. When there is a need to apply the electrical plug of such a design to a receptacle sequence having more than two receptacles, a too large space will be occupied and adjacent receptacles will be blocked due to the too large transverse dimension of the electrical plug, which causes inconvenience in use.

U.S. Pat. No. 7,566,223 discloses an electrical connector having three tubular conductors which are vertically stacked in sequence. Although the aforesaid problem of the too large transverse dimension of the electrical plug is eliminated, there is a shortcoming that a longitudinal dimension of the electrical plug is too large, which is likely to cause inconvenience in storage. Moreover, when there is a need to plug this electrical plug into a receptacle behind a piece of furniture, the electrical plug may fail to extend to the behind of the furniture due to the too large thickness.

Referring to FIG. 1, there is shown a perspective exploded view of a rotatable electrical plug of the prior art. China Utility Model No. 2,253,877 discloses a rotatable electrical plug 10, which uses two tabular conductors and one tubular conductor 13 simultaneously to reduce both the longitudinal dimension and the transverse dimension of the electrical plug 10. Moreover, the electrical plug 10 further uses a U-shaped metal annulus 11 and a U-shaped metal annulus 12 in place of the two tabular conductors to reduce the transverse dimension of the electrical plug 10. Although the transverse dimension of the electrical plug 10 can be slightly reduced by using the U-shaped metal annulus 11 and the U-shaped metal annulus 12 simultaneously, a spring (not shown) is still used thereunder to push the U-shaped metal annulus 11 and the U-shaped metal annulus 12 upwards to electrically connect with electrode ends 16 of plug pins 15. The upward elastic force will add to the difficulty in packaging of an upper housing 17 and a lower housing 18. Accordingly, it is desirable to develop a rotatable electrical plug that allows to be packaged more conveniently and has a reduced volume.

SUMMARY OF THE INVENTION

The present invention provides a rotatable electrical plug, which comprises a housing, a first conductor, a second conductor, a third conductor and a rotator. The primary objective of the present invention is to reduce the overall volume of the rotatable electrical plug to provide convenience in use.

The present invention provides a rotatable electrical plug, comprising: a housing, comprising: a lower housing; and an upper housing, being correspondingly joined with the lower housing and having an opening; a first conductor, being of a tubular form formed by a single metal sheet, and being disposed on the lower housing and located in a first conductive region; a second conductor, being of a tubular form formed by a single metal sheet, and being disposed on the lower housing and located in a second conductive region; a third conductor, being disposed on the lower housing and located in a third conductive region, wherein the first conductor, the second conductor and the third conductor are electrically isolated from each other; and a rotator, being joined in the opening and comprising a first electrode terminal, a second electrode terminal and a third electrode terminal, wherein the first electrode terminal, the second electrode terminal and the third electrode terminal that are electrically isolated from each other penetrate through the rotator and are fixedly disposed on the rotator, and the inside of the rotator is correspondingly formed with a first contactor electrically contacted with the first conductor, a second contactor electrically contacted with the second conductor and a third contactor electrically contacted with the third conductor, wherein projection regions of the first conductive region and the second conductive region in a normal direction of the lower housing are overlapped.

With implementations of the present invention, at least the following progressive efficacies can be achieved:

I. the transverse dimension and the longitudinal dimension of the rotatable electrical plug can be reduced; and II. the difficulty in packaging of the electrical plug can be reduced.

Hereinafter, the detailed features and advantages of the present invention are described in detail by way of the preferred embodiments of the present invention so as to enable persons skilled in the art to gain insight into the technical disclosure of the present invention, implement the present invention accordingly, and readily understand the objectives and advantages of the present invention by making reference to the disclosure of the specification, the claims, and the drawings of the present invention.

DETAILED DESCRIPTION OF THE INVENTION

Figure 1:
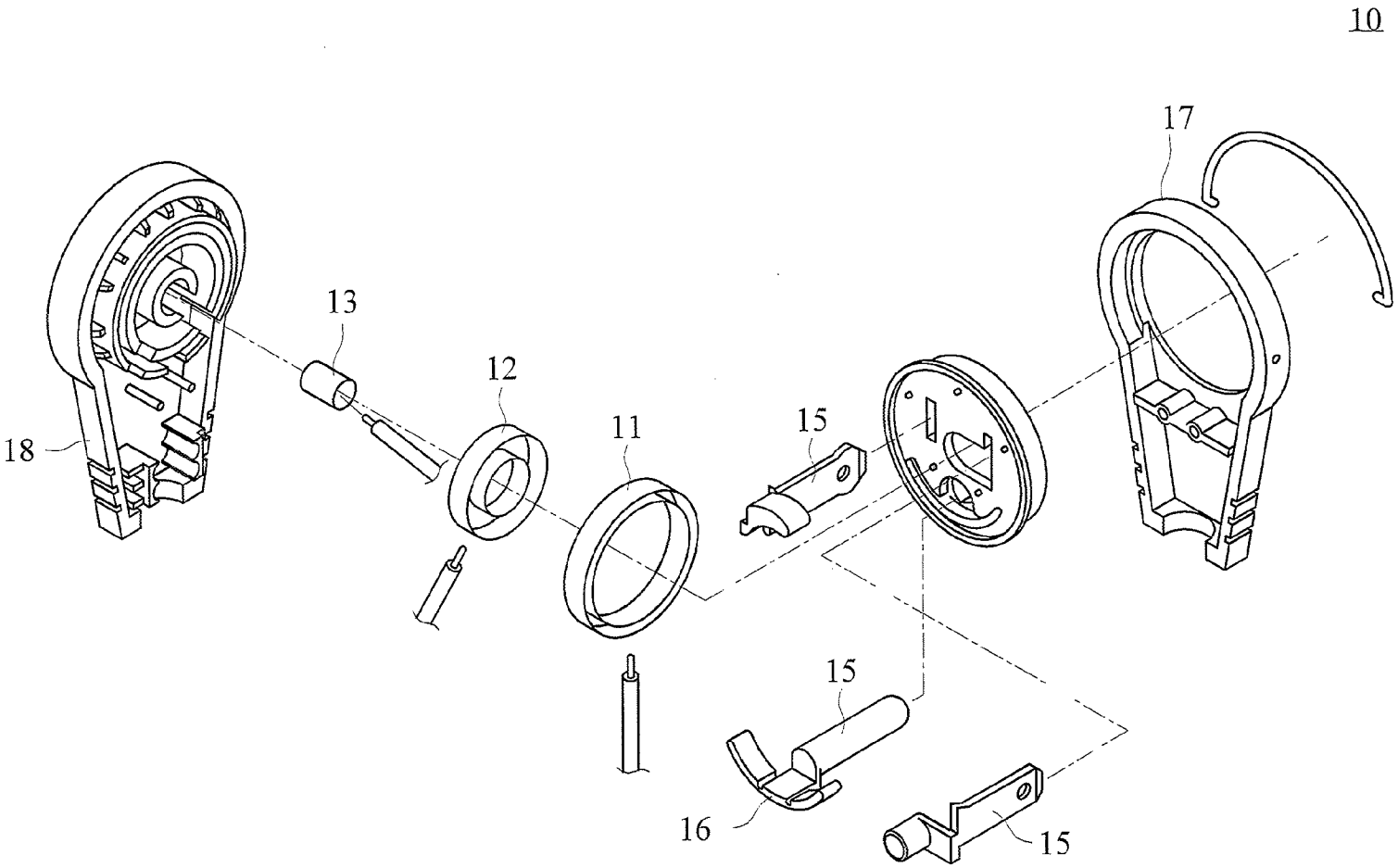
FIG. 1 (PRIOR ART)
FIG. 1 is a perspective exploded view of a rotatable electrical plug of the prior art.
Figure 2:
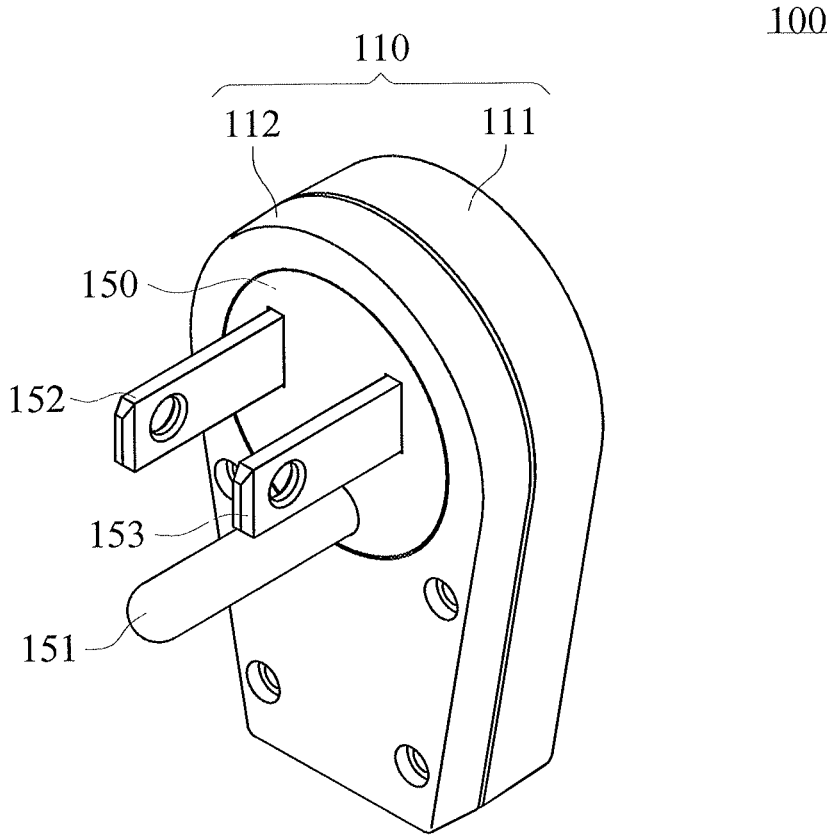
FIG. 2 is a perspective assembly view of a rotatable electrical plug according to an embodiment of the present invention.
Figure 3:
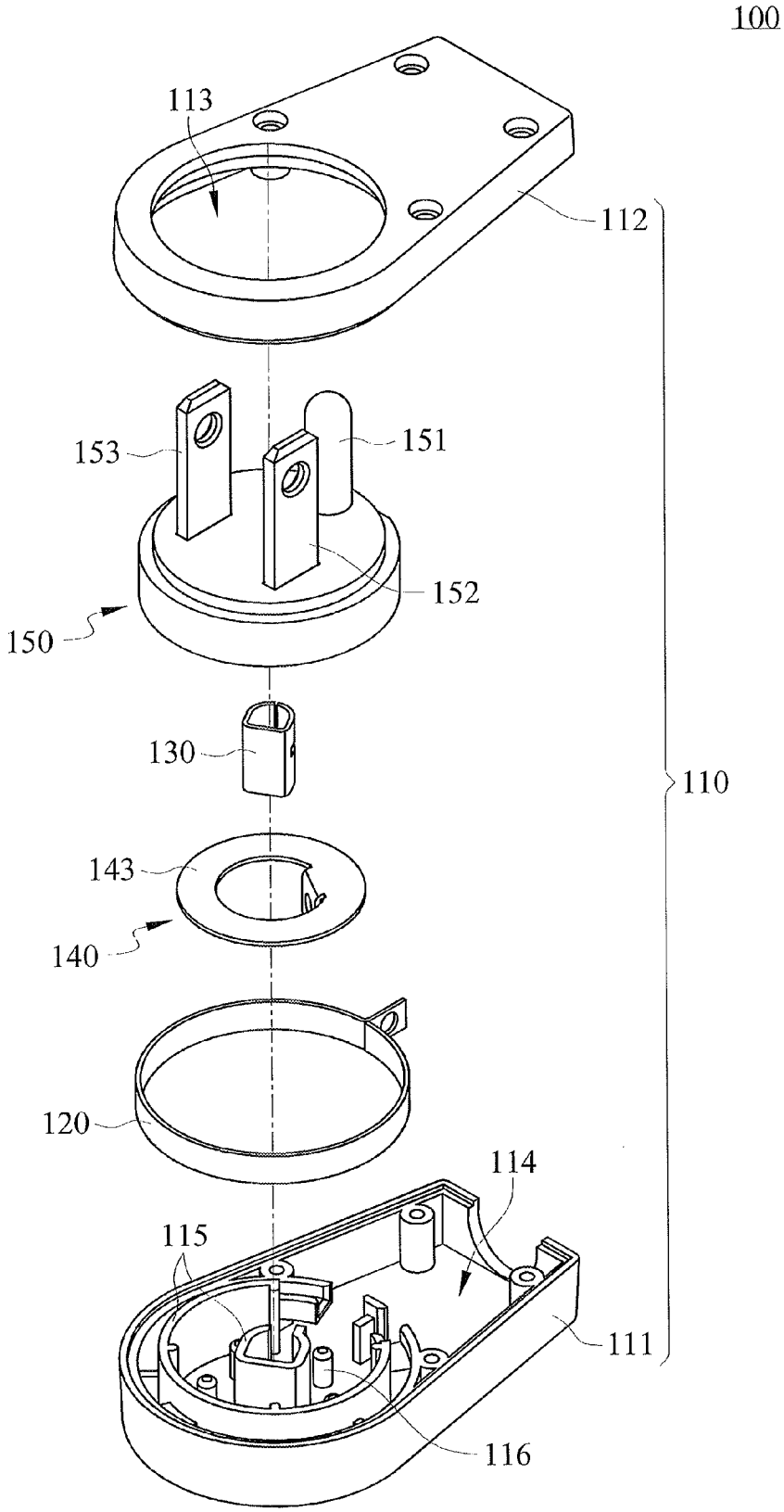
FIG. 3 is a perspective exploded view of the rotatable electrical plug according to the embodiment of the present invention.

As shown in FIG. 2 and FIG. 3, this embodiment is a rotatable electrical plug 100 which comprises a housing 110, a first conductor 120, a second conductor 130, a third conductor 140 and a rotator 150.

The housing 110 comprises a lower housing 111 and an upper housing 112. The upper housing 112 and the lower housing 111 are joined together correspondingly, and the lower housing 111 further has a receiving recess 114 so that a receiving space is formed within the housing 110 to receive necessary elements. The upper housing 112 has an opening 113, which can be used to receive the rotator 150 so that the rotator 150 can rotate freely in the opening 113. Furthermore, a plurality of partitions 115 or separation columns 116 may be disposed as needed in the receiving recess 114 of the lower housing 111 to fix or separate the elements in the housing 110.

Figure 4:
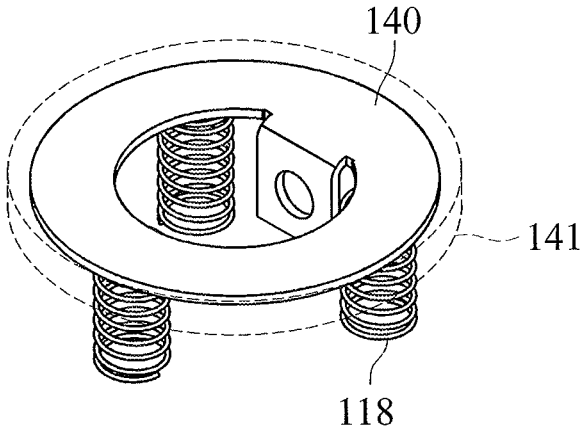
FIG. 4 is a schematic view illustrating a relationship between conductors and conductive regions according to the embodiment of the present invention.

As shown in FIG. 3 and FIG. 4, the first conductor 120 is of a tubular form formed by a single metal sheet, and is disposed in the receiving recess 114 of the lower housing 111 and located in a first conductive region. The first conductive region is defined as a three-dimensional (3D) space occupied by the first conductor 120 within the housing 110, and further comprises a small error space generated in the manufacturing and installation processes and a small shift space that is possibly generated by the first conductor 120 within the housing 110. Therefore, the first conductive region is actually slightly larger than the volume of the first conductor 120 so as to ensure electric conduction of the first conductor 120 in the first conductive region. The second conductor 130 is of a tubular form formed by a single metal sheet, and is disposed in the receiving recess 114 of the lower housing 111 and located in a second conductive region. The third conductor 140 is disposed in the receiving recess 114 of the lower housing 111 and located in a third conductive region. The second conductive region and the third conductive region are defined in the same way as the first conductive region to ensure electric conduction of the second conductor 130 and the third conductor 140 in the second conductive region and the third conductive region respectively.

As shown in FIG. 4, the third conductor 140 will be taken as an example to more clearly describe the relationship between the conductors and the conductive regions. In order to ensure electric conduction of the third conductor 140 in the third conductive region 141 when an elastic element 118 is disposed underneath the third conductor 140, the third conductive region 141, apart from comprising the 3D space occupied by the third conductor 140, further comprises a small error space generated in the manufacturing and installation processes and a small shift space that is possibly generated by the third conductor 140 due to disposition of the elastic element 118 (e.g., expansion and contraction of the elastic element 118). For purpose of convenience in the following description, the conductive regions are all set to be the same as the spaces in which the conductors are located herein.

As shown in FIG. 3 and FIG. 6A to FIG. 6D, by using for example the partitions 115 or the separation columns 116, the first conductor 120, the second conductor 130 and the third conductor 140 can be electrically isolated from each other to prevent electrical contact therebetween. The first conductor 120, the second conductor 130 and the third conductor 140 may be arranged in the following ways in a horizontal direction of the lower housing 111: center-middle-periphery, middle-center-periphery, middle-periphery-center, periphery-middle-center, periphery-center-middle and center-periphery-middle.

The third conductor 140 may be of a sheet form or a tubular form formed by a single metal sheet, but the first conductor 120 and the second conductor 130 are only of a tubular form formed by a single metal sheet. Accordingly, the first conductor 120, the second conductor 130 and the third conductor 140 may be implemented in the following ways from inside to outside in the horizontal direction of the lower housing 111: tube-sheet-tube, tube-tube-sheet, sheet-tube-tube and tube-tube-tube. The tubular form formed by a single metal sheet is not particularly limited, and may be a short tubular form, a long tubular form, a wide tubular form or a narrow tubular form; and the sheet form is not particularly limited either, and may be a circular sheet form, an annular sheet form or an irregular sheet form.

Figure 6A:
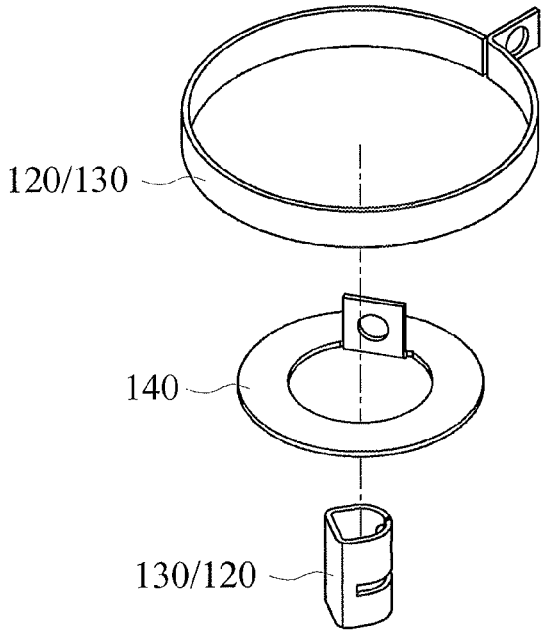
FIG. 6A is a schematic view illustrating an implementation I of forms of the conductors of FIG. 3.
Figure 6B:
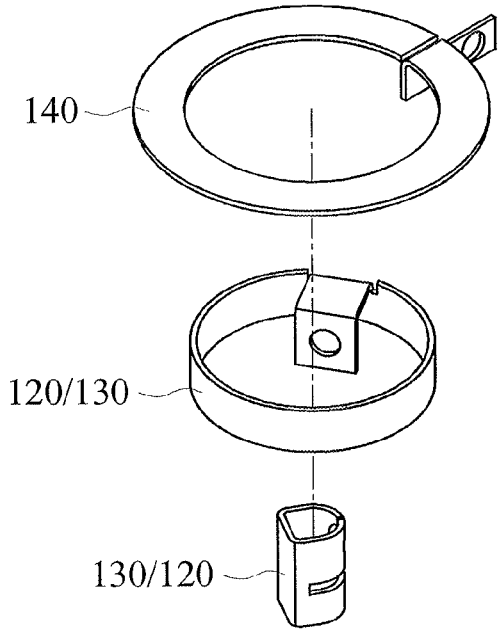
FIG. 6B is a schematic view illustrating an implementation II of the forms of the conductors of FIG. 3.
Figure 6C:
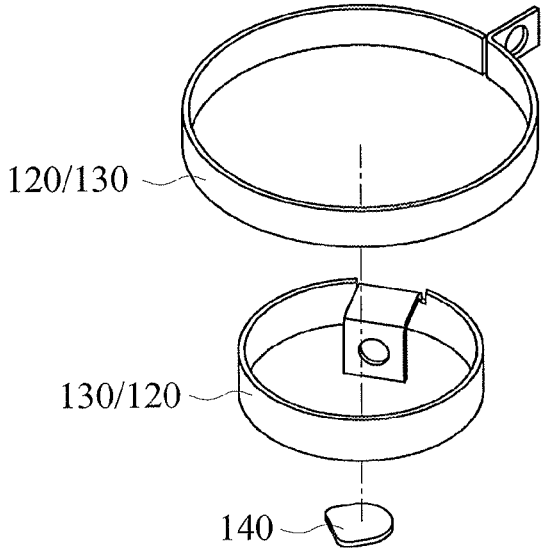
FIG. 6C is a schematic view illustrating an implementation III of the forms of the conductors of FIG. 3.
Figure 6D:
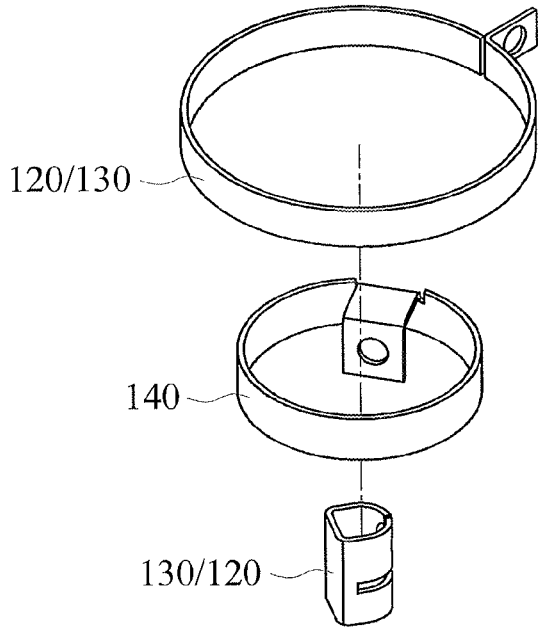
FIG. 6D is a schematic view illustrating an implementation IV of the forms of the conductors of FIG. 3.

As shown in FIG. 6A and FIG. 6B, when the first conductor 120, the second conductor 130 and the third conductor 140 are implemented from inside to outside in the form of tube-sheet-tube or tube-tube-sheet, the third conductor 140 may be of an annular sheet form. As shown in FIG. 6C, when the first conductor 120, the second conductor 130 and the third conductor 140 are implemented from inside to outside in the form of sheet-tube-tube, the third conductor 140 may be of a circular sheet form in order to effectively reduce the transverse dimension of the electrical plug 100. Further as shown in FIG. 6D, when the first conductor 120, the second conductor 130 and the third conductor 140 are implemented from inside to outside in the form of tube-tube-tube, the transverse dimension of the electrical plug 100 can still be reduced significantly with the three conductors 120, 130, 140 being electrically isolated from each other because the conductors of the tubular form formed by a single metal sheet occupy a minimum area in a transverse direction.

Figure 7:
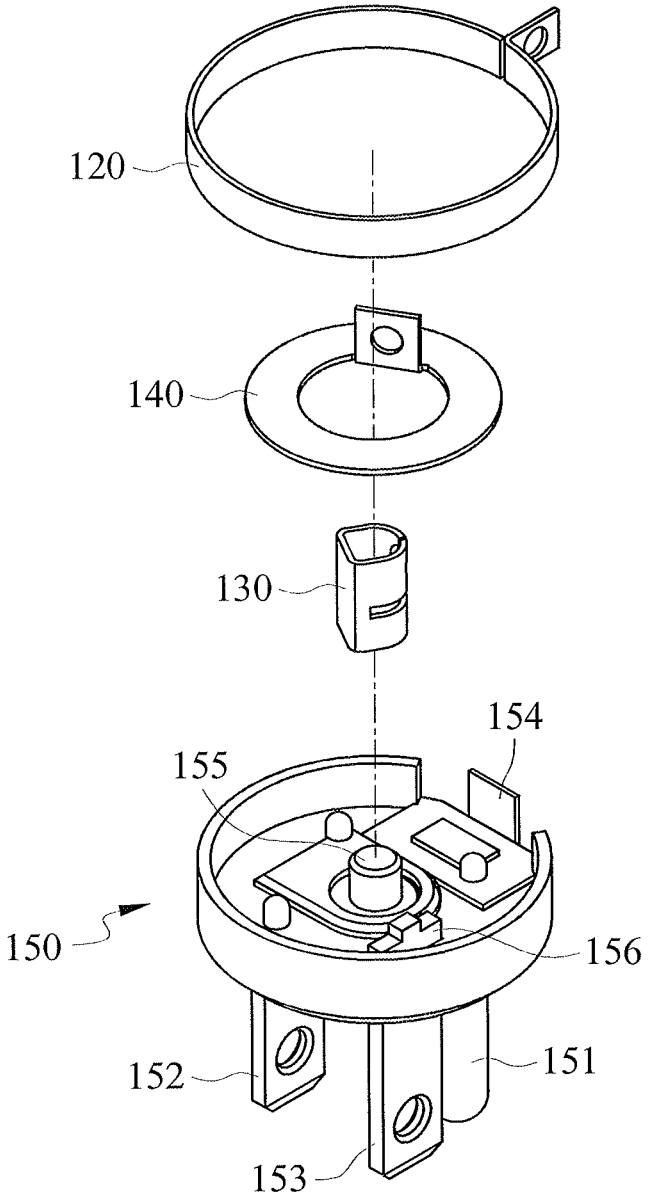
FIG. 7 is a bottom view of a rotator of FIG. 3.

As shown in FIG. 3 and FIG. 7, the rotator 150 is joined in the opening 113 of the upper housing 112. The rotator 150 comprises a first electrode terminal 151, a second electrode terminal 152 and a third electrode terminal 153. The first electrode terminal 151, the second electrode terminal 152 and the third electrode terminal 153 that are electrically isolated from each other penetrate through the rotator 150 from the outer surface of the rotator 150 and are fixedly disposed on the inner surface of the rotator 150. Moreover, the inner surface of the rotator 150 is correspondingly formed with a first contactor 154, a second contactor 155 and a third contactor 156, which are electrically contacted with the first conductor 120, the second conductor 130 and the third conductor 140 respectively.

Thus, the first electrode terminal 151, the second electrode terminal 152 and the third electrode terminal 153 can be electrically contacted with the first conductor 120, the second conductor 130 and the third conductor 140 via the first contactor 154, the second contactor 155 and the third contactor 156 respectively; and when the rotator 150 rotates freely in the opening 113, the first conductor 120, the second conductor 130 and the third conductor 140 all keep in electrical contact with the first contactor 154, the second contactor 155 and the third contactor 156 respectively so that the electrical plug 100 can still maintain a good electric conduction state while being rotatable.

When the first conductor 120, the second conductor 130 and the third conductor 140 are of a tubular form formed by a single metal sheet, the tubular metal sheets have an elastic force directing outwards, and this elastic force can ensure that side edges of the first conductor 120, the second conductor 130 and the third conductor 140 will be necessarily contacted with the first contactor 154, the second contactor 155 and the third contactor 156 respectively. Thereby, the external electric power is transmitted to the first conductor 120, the second conductor 130 and the third conductor 140 from the first contactor 154, the second contactor 155 and the third contactor 156 via the electrical contact. Furthermore, for convenience in arrangement of electrical wires connected to the conductors, at least one of the first conductor 120, the second conductor 130 and the third conductor 140 may have a shim element (not shown) disposed thereunder to keep some space for the electrical wires to pass therethrough.

Referring to FIG. 4, when the third conductor 140 is of a sheet form, an upper surface 143 of the third conductor 140 is electrically contacted with the third contactor 156. In order to have the third conductor 140 closely contact with the third contactor 156, at least one elastic element 118 may be disposed between the third conductor 140 and the lower housing 111 to push the third conductor 140 against the third contactor 156.

Figure 5:
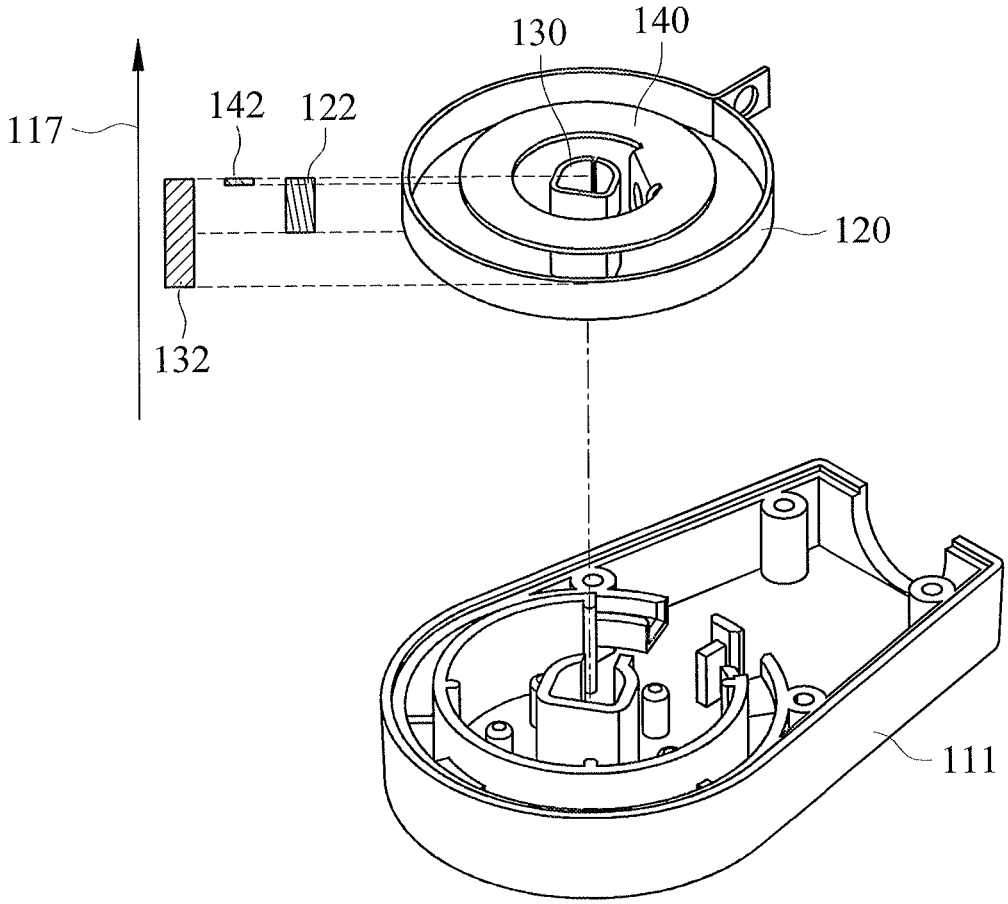
FIG. 5 is a schematic view illustrating projection regions of the conductive regions of the rotatable electrical plug according to the embodiment of the present invention.

As shown in FIG. 5, in this embodiment, a projection region of the first conductive region in a normal direction 117 of the lower housing is defined as a first projection range 122. Likewise, a projection region of the second conductive region in the normal direction 117 of the lower housing is defined as a second projection range 132, and a projection region of the third conductive region in the normal direction 117 of the lower housing is defined as a third projection range 142. The projection regions of the first conductive region and the second conductive region in the normal direction 117 of the lower housing are overlapped with each other, and may be partially overlapped or completely overlapped. That is, the first projection range 122 and the second projection range 132 may be partially overlapped or completely overlapped.

Figure 8A:
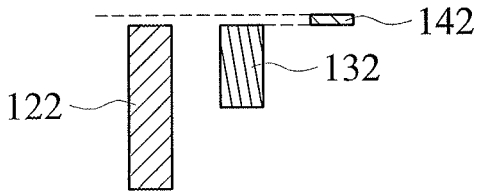
FIG. 8A is a schematic view illustrating an implementation I of a first projection range, a second projection range and a third projection range of FIG. 5.
Figure 8B:
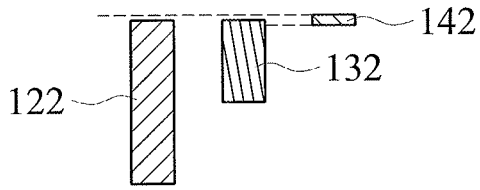
FIG. 8B is a schematic view illustrating an implementation II of the first projection range, the second projection range and the third projection range of FIG. 5.
Figure 8C:
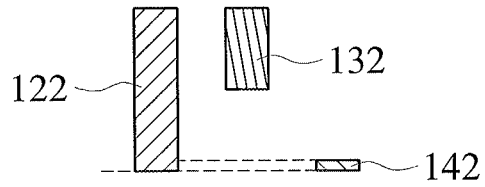
FIG. 8C is a schematic view illustrating an implementation III of the first projection range, the second projection range and the third projection range of FIG. 5.

As shown in FIG. 8A to FIG. 8C, in the case that the first projection range 122 and the second projection range 132 are completely overlapped, the projection region of the third conductive region in the normal direction 117 of the lower housing may be completely not overlapped with the projection regions of the first conductive region and the second conductive region in the normal direction 117 of the lower housing; that is, the third projection range 142 is overlapped with neither the first projection range 122 nor the second projection range 132 (as shown in FIG. 8A). Further, when the projection regions of the third conductive region and at least one of the first conductive region and the second conductive region in the normal direction 117 of the lower housing are partially overlapped, the third projection range 142 may be partially overlapped with at least one of the first projection range 122 and the second projection range 132 (not shown), or may be partially overlapped with both the first projection range 122 and the second projection range 132 (as shown in FIG. 8B). Moreover, when the projection regions of the third conductive region and at least one of the first conductive region and the second conductive region in the normal direction 117 of the lower housing are completely overlapped, the third projection range 142 may be completely overlapped with at least one of the first projection range 122 and the second projection range 132 (as shown in FIG. 8C), or may be completely overlapped with both the first projection range 122 and the second projection range 132 (not shown).

Figure 9A:
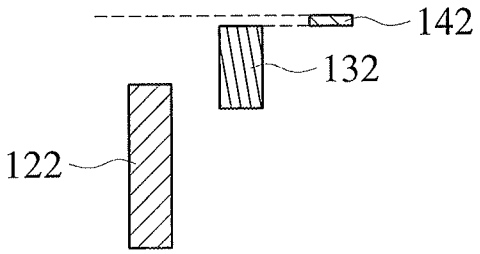
FIG. 9A is a schematic view illustrating an implementation IV of the first projection range, the second projection range and the third projection range of FIG. 5.
Figure 9B:
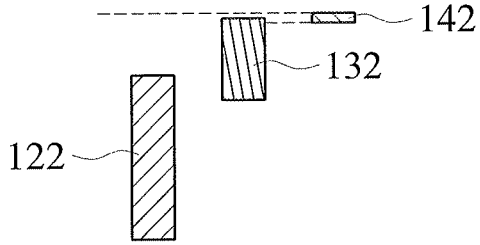
FIG. 9B is a schematic view illustrating an implementation V of the first projection range, the second projection range and the third projection range of FIG. 5.
Figure 9C:
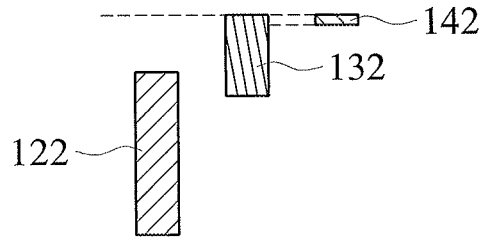
FIG. 9C is a schematic view illustrating an implementation VI of the first projection range, the second projection range and the third projection range of FIG. 5.

As shown in FIG. 9A to FIG. 9C, likewise, in the case that the first projection range 122 and the second projection range 132 are partially overlapped, the third projection range 142 may be overlapped with neither the first projection range 122 nor the second projection range 132 (as shown in FIG. 9A). The third projection range 142 may be partially overlapped with at least one of the first projection range 122 and the second projection range 132 (as shown in FIG. 9B). The third projection range 142 may be completely overlapped with at least one of the first projection range 122 and the second projection range 132 (as shown in FIG. 8C). Moreover, because the third conductor 140 may be of a sheet form or a tubular form formed by a single metal sheet, the third projection range 142 formed through projection of the sheet form shown in FIG. 8A to FIG. 9C may also be altered into a third projection range 142 formed through projection of the tubular form formed by a single metal sheet. Therefore, this embodiment may have various implementations, which will not be further described herein.

As shown in FIG. 3 to FIG. 5, the rotatable electrical plug 100 of this embodiment can ease the difficulty in packaging. When three conductors (e.g., 140) of a sheet form are assembled, the elastic element 118 between the conductors of the sheet form and the lower housing 111 will push the conductors of the sheet form upwards, which makes it uneasy to assemble the upper housing 112 and the lower housing 111. However, the elastic force of conductors (e.g., 120) of a tubular form formed by a single metal sheet is in the transverse direction, which will not affect assembly of the upper housing 112 and the lower housing 111. Therefore, use of more than two conductors of a tubular form formed by a single metal sheet can ease the difficulty in assembly. Moreover, the tubular form formed by a single metal sheet has a thinner transverse width than the U-shaped metal annulus of the prior art, and thus can significantly reduce the transverse dimension of the electrical plug 100.

More importantly, by skillfully using the transverse arrangement (center, middle and periphery) and longitudinal projection overlapping methods in combination with arrangement of the elastic element 118, the shim element and the like, all of the conductors and the electrical wires are disposed in such a way that the longitudinal dimension of the electrical plug 100 can be reduced. Particularly when the first conductor 120, the second conductor 130 and the third conductor 140 are each of a tubular form formed by a single metal sheet and the projection regions thereof in the normal direction 117 of the lower housing can be completely overlapped, the longitudinal dimension of the electrical plug 100 can be reduced to the minimum.

Additionally, the conductors of the tubular form formed by a single metal sheet have a smaller volume, which can naturally save materials of the conductors. Moreover, the conductors of the tubular form formed by a single metal sheet can be closely contacted with the contactors without the need of the elastic element 118, so the materials of the elastic element 118 can be saved. Therefore, the structure of the rotatable electrical plug 100 of this embodiment can achieve the effects of reducing the volume, saving the materials and allowing for easy packaging.

The features of the present invention are disclosed above by the preferred embodiments to allow persons skilled in the art to gain insight into the contents of the present invention and implement the present invention accordingly. The preferred embodiments of the present invention should not be interpreted as restrictive of the scope of the present invention. Hence, all equivalent modifications or amendments made to the aforesaid embodiments should fall within the scope of the appended claims.

What is claimed is:

1. A rotatable electrical plug, comprising:

a housing, comprising:

a lower housing; and an upper housing correspondingly joined with the lower housing and having an opening;

a tubular first conductor formed by a single metal sheet, the first conductor disposed on the lower housing and located in a first conductive region, wherein the first conductor has an internal radius and an external radius, the difference between the internal radius and the external radius is identical to a thickness of the single metal sheet and smaller than a width of the single metal sheet;

a tubular second conductor formed by a single metal sheet, and being disposed on the lower housing and located in a second conductive region;

a third conductor disposed on the lower housing and located in a third conductive region, wherein the first conductor surrounds the second conductor and the third conductor, wherein the first conductor, the second conductor and the third conductor are electrically isolated from each other; and a rotator joined in the opening and comprising a first electrode terminal, a second electrode terminal and a third electrode terminal, wherein the first electrode terminal, the second electrode terminal and the third electrode terminal are electrically isolated from each other penetrate through the rotator and are fixedly disposed on the rotator, and the inside of the rotator is correspondingly formed with a first contactor electrically contacted with the first conductor, a second contactor electrically contacted with the second conductor, and a third contactor electrically contacted with the third conductor, wherein projection regions of the first conductive region and the second conductive region in a normal direction of the lower housing are overlapped.

2. The electrical plug of claim 1, wherein the projection regions are partially overlapped or completely overlapped.

3. The electrical plug of claim 2, wherein side edges of the first conductor, the second conductor and the third conductor of the tubular form are contacted with the first contactor, the second contactor and the third contactor respectively.

4. The electrical plug of claim 2, wherein an upper surface of the third conductor of the sheet form is electrically contacted with the third contactor.

5. The electrical plug of claim 4, wherein at least one elastic element is disposed between the third conductor and the lower housing.

6. The electrical plug of claim 2, wherein the third conductor is of a sheet form or a tubular form formed by a single metal sheet, and a projection region of the third conductive region in the normal direction of the lower housing is not overlapped with the projection regions of the first conductive region and the second conductive region in the normal direction of the lower housing.

7. The electrical plug of claim 6, wherein side edges of the first conductor, the second conductor and the third conductor of the tubular form are contacted with the first contactor, the second contactor and the third contactor respectively.

8. The electrical plug of claim 6, wherein an upper surface of the third conductor of the sheet form is electrically contacted with the third contactor.

9. The electrical plug of claim 8, wherein at least one elastic element is disposed between the third conductor and the lower housing.

10. The electrical plug of claim 6, wherein at least one of the first conductor, the second conductor and the third conductor has a shim element thereunder.

11. The electrical plug of claim 2, wherein the third conductor is of a sheet form or a tubular form formed by a single metal sheet, and the projection regions of the third conductive region and at least one of the first conductive region and the second conductive region in the normal direction of the lower housing are at least partially overlapped.

12. The electrical plug of claim 11, wherein side edges of the first conductor, the second conductor and the third conductor of the tubular form are contacted with the first contactor, the second contactor and the third contactor respectively.

13. The electrical plug of claim 11, wherein an upper surface of the third conductor of the sheet form is electrically contacted with the third contactor.

14. The electrical plug of claim 11, wherein at least one of the first conductor, the second conductor and the third conductor has a shim element thereunder.

15. A rotatable electrical plug, comprising:

a housing, comprising:

a lower housing; and an upper housing correspondingly joined with the lower housing and having an opening;

a tubular first conductor formed by a single metal sheet, the first conductor disposed on the lower housing and located in a first conductive region, wherein the first conductor has an internal radius and an external radius, the difference between the internal radius and the external radius is identical to a thickness of the single metal sheet and smaller than a width of the single metal sheet;

a tubular second conductor formed by a single metal sheet, and being disposed on the lower housing and located in a second conductive region;

a sheet-like third conductor disposed on the lower housing and located in a third conductive region, wherein the first conductor surrounds the second conductor and the third conductor, and the third conductor is arranged at the center of the first conductor, wherein the first conductor, the second conductor and the third conductor are electrically isolated from each other; and a rotator joined in the opening and comprising a first electrode terminal, a second electrode terminal and a third electrode terminal, wherein the first electrode terminal, the second electrode terminal and the third electrode terminal are electrically isolated from each other penetrate through the rotator and are fixedly disposed on the rotator, and the inside of the rotator is correspondingly formed with a first contactor electrically contacted with the first conductor, a second contactor electrically contacted with the second conductor, and a third contactor electrically contacted with the third conductor, wherein the third contactor is abutted against a planar upper surface of the third conductor, wherein projection regions of the first conductive region and the second conductive region in a normal direction of the lower housing are overlapped.

* * * * *